United States Patent [19]

Knecht

[11] Patent Number: 4,732,337

[45] Date of Patent: Mar. 22, 1988

[54] MEAT CHOPPER BLADE HEAD

[75] Inventor: Manfred Knecht, Bergatreute, Fed. Rep. of Germany

[73] Assignee: Knecht Maschinenbau GmbH, Bergatreute, Fed. Rep. of Germany

[21] Appl. No.: 53,894

[22] Filed: May 26, 1987

[30] Foreign Application Priority Data

May 23, 1986 [DE] Fed. Rep. of Germany ..... 3617349

[51] Int. Cl.[4] ..... B02C 18/20

[52] U.S. Cl. ..... 241/292.1; 83/664; 241/282.2

[58] Field of Search ..... 241/282.1, 282.2, 292.1; 83/664, 665, 666, 676, 677, 425.3

[56] References Cited

U.S. PATENT DOCUMENTS

| | | | |
|---|---|---|---|
| 3,279,296 | 10/1966 | Jung et al. | 83/664 |
| 3,897,020 | 7/1975 | Knecht | 241/292.1 |
| 4,429,837 | 2/1984 | Knecht | 241/292.1 |

*Primary Examiner*—E. R. Kazenske
*Assistant Examiner*—Eugenia A. Jones
*Attorney, Agent, or Firm*—Spencer & Frank

[57] ABSTRACT

A blade assembly for a meat cutter, which assembly includes a drive shaft having an axis, a plurality of driving discs made of light metal mounted on the drive shaft, a plurality of cutting blades alternating with the driving discs along the shaft to form a stack with the driving discs, two end pieces mounted on the shaft and each disposed at a respective end of the stack, the driving discs being connected in a form locking manner with the shaft and the blades being axially clamped between the driving discs in a force transmitting manner, a plurality of outer rings of chemically resistant plastic material each disposed around a respective one of the driving discs and end pieces, and being substantially coextensive, parallel to the shaft axis, with the associated driving disc or end piece, and each ring having a radial dimension substantially equal to the axial dimension of each driving disc, and a plurality of sealing rings of a chemically resistant plastic elastomeric material each pressed into a respective outer ring via an associated axial end face of the outer ring such that each sealing ring protrudes for a distance into the respective outer ring via the associated end face, with each outer ring which is disposed around a driving disc having a sealing ring at each end face and each outer ring which is disposed around an end piece having a sealing ring at that end face which faces inwardly of the stack.

4 Claims, 2 Drawing Figures

MEAT CHOPPER BLADE HEAD

BACKGROUND OF THE INVENTION

The present invention relates to a blade head for a meat chopper whose blades are disposed between driving discs and are connected with the discs in order to be driving. Together with the driving discs, the blades, axially clamped on a drive shaft between end pieces, form the blade head, with the driving discs and the end pieces being connected with the drive shaft in a form locking manner.

Such a blade head is disclosed, for example, in U.S. Pat. No. 4,429,837. In order to eliminate damaging influences from chemical components, particularly cavitation erosion, spacer rings made of a chemically resistant plastic are provided between the blades of the blade head and the steel driving discs are inserted between these spacer rings.

Although this blade head has proven itself in practical operation, it has been found that the steel driving discs constitute a disadvantageous additional expense because of the high quality material employed and the precision work required for their manufacture. Moreover, these driving discs must be made relatively thin in order to provide sufficient strength for the blade bases and to limit the axial length of the set of blades to a useful dimension. Thus, during transmission of the driving energy, the regions of the driving disc especially exposed to stresses are subjected to very high specific material stresses which may possibly cause uncontrollable damage and critical operating states.

SUMMARY OF THE INVENTION

It is an object of the present invention to overcome the above drawbacks without special additional expenditures, while retaining a favorable structural length of the blade head and the effective shielding of the blades against chemical influences.

The above and other objects are achieved, according to the invention, in a blade assembly for a meat cutter, which assembly includes a drive shaft having an axis, a plurality of driving discs made of light metal mounted on the drive shaft, a plurality of cutting blades alternating with the driving discs along the shaft to form a stack with the driving discs, and two end pieces mounted on the shaft and each disposed at a respective end of the stack, the driving discs being connected in a form locking manner with the shaft and the blades being axially clamped between the driving discs in a force transmitting manner, by the provision of: a plurality of outer rings of chemically resistant plastic material each disposed around a respective one of the driving discs and end pieces, each ring having two axial end faces and an axial dimension, between the end face and parallel to the shaft axis, such that the ring is substantially coextensive, parallel to the shaft axis, with the associated driving disc or end piece, and each ring having a radial dimension, perpendicular to the shaft axis, substantially equal to the axial dimension, parallel to the shaft axis, of each driving disc; and a plurality of sealing rings of a chemically resistant plastic elastomeric material each pressed into a respective outer ring via an associated axial end face of the respective outer ring such that each sealing ring protrudes for a distance into the respective outer ring via the associated axial end face, with each outer ring which is disposed around a respective driving disc having a respective sealing ring at each axial end face and each outer ring which is disposed around a respective end piece having a respective sealing ring at that axial end face which faces inwardly of the stack, and with the sealing rings being concentric to the axis of the shaft.

By configuring the driving discs as light metal intermediate discs, the individual components in the form of the steel driving discs can now be omitted, which simultaneously brings about the advantage that the light metal driving discs can be given such dimensions that they are able to withstand all occurring cases of stress without thus necessitating enlargement of the axial structural length of the blade head.

However, to employ these advantages in a useful manner, the invention provides that the driving discs and the end pieces are each provided with a concentric, fixed outer ring which is composed of a chemically resistant plastic and is equipped on both sides with an elastomer sealing ring, thus shielding the metal parts against chemical influences.

Additionally, due to their dimensions and the material of which they are made, the outer rings according to the invention exhibit vibration attenuating effects so that the danger of blades breaking in the critical transition region between the point where they are clamped in and the exposed part of the blade is considerably reduced.

The means of the invention for the configuration of the blade head retain and supplement the advantages of the prior art embodiments while eliminating their drawbacks.

DESCRIPTION OF THE PREFERRED EMBODIMENTS

Figure 1:
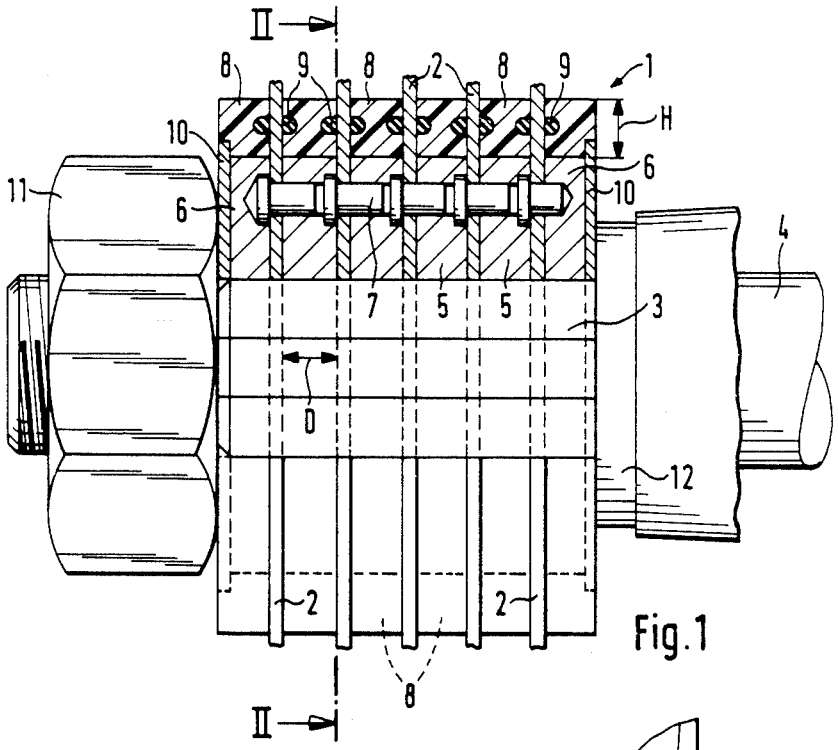
FIG. 1 is a partly cross-sectional view of a blade head according to a preferred embodiment of the invention.
Figure 2:
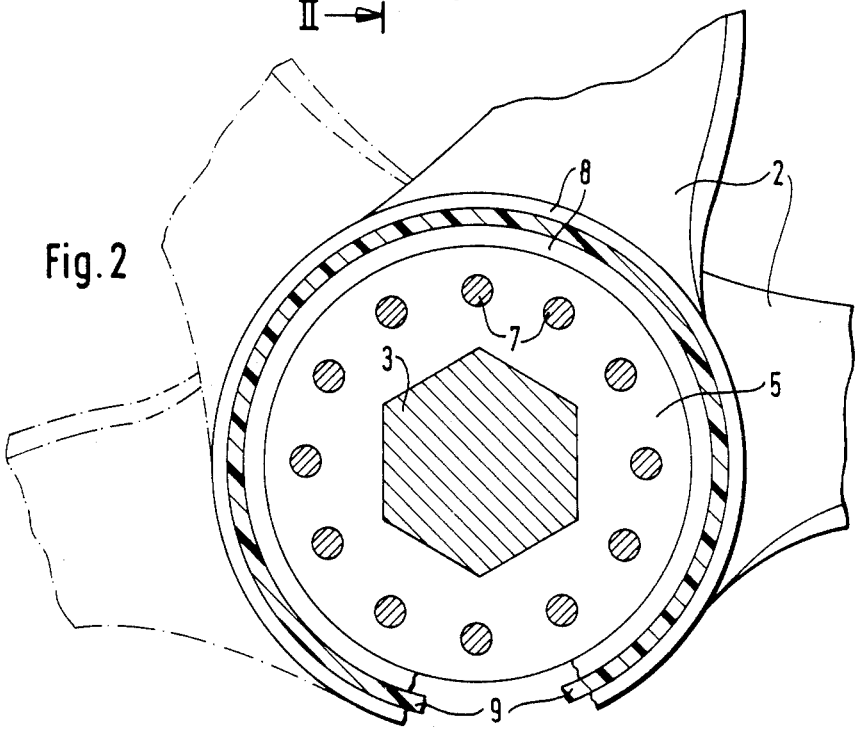
FIG. 2 is a cross-sectional detail view along line I—I of FIG. 1.

As shown in FIGS. 1 and 2, blade head 1 is provided, for example, with five chopping blades 2 which are angularly offset with respect to one another in a known manner and are connected in a form locking, or positive locking, manner with a support member 3 in the form of a regular polygon forming an end portion of drive shaft 4. Chopping blades 2 are interposed between driving discs 5 and end pieces 6, with plug-in bolts 7 being provided to transfer the driving forces from discs 5 and pieces 6 to blades 2. These bolts are inserted through corresponding bores in driving discs 5 and blades 2.

Driving discs 5 and end pieces 6 are made of a suitable light metal, e.g. aluminum, alloy and are each provided with a pressed-on outer ring 8 made of a chemically resistant material, e. g. polyoxymethylene (POM). The radial height H of each ring 8 corresponds approximately to the thickness D of each driving disc 5. A sealing ring 9 of an elastomer, chemically resistant plastic, e.g. POM, is pressed into each axial end face of each outer ring 8 associated with a disc 5 and into each inner axial end face of each ring 8 associated with an end piece 6. In the unstressed state of the assembly, rings 9 project beyond the axial end faces of rings 8.

A respective concentric terminating disc 10 made of steel is placed into the outer axial end face of each outer ring 8 and is pressed in such a manner that its outer face is flush with the outer face of ring 8 and its inner face lies closely against the adjacent end piece 6.

The stated parts of blade head 1 which are pushed onto member 3 are axially clamped together by means of a clamping nut 11 which engages a threaded stud secured to the end of member 3, with terminating discs 10 transferring the clamping force between the clamping nut and a shaft collar 12 to the components of blade head 1. In addition to the highly stressable stability of blade head 1, this arrangement also ensures the desired seal between the blades and the driving discs as well as attenuation of blade vibrations.

The invention now being fully described, it will be apparent to one of ordinary skill in the art that many changes and modifications can be made thereto without departing from the spirit or scope of the invention as set forth herein.

The present disclosure relates to the subject matter disclosed in German Application No. P 36 17 349.5-23 of May 23rd, 1986, the entire specification of which is incorporated herein by reference.

What is claimed:

1. In a blade assembly for a meat cutter, which assembly includes a drive shaft having an axis a plurality of driving discs mounted on the drive shaft, a plurality of cutting blades alternating with the driving discs along the shaft to form a stack with the driving discs, and two end pieces mounted on the shaft and each disposed at a respective end of the stack, the driving discs being connected in a form locking manner with the shaft and the blades being axially clamped between the driving discs in a force transmitting manner, the improvement wherein said driving discs are entirely of a light metal and said assembly comprises: a plurality of outer rings of chemically resistant plastic material each disposed around a respective one of said driving discs and end pieces, each said ring having two axial end faces and an axial dimension, between said end faces and parallel to the shaft axis, such that said ring is substantially coextensive, parallel to the shaft axis, with the associated driving disc or end piece, and each said ring having a radial dimension, perpendicular to the shaft axis, substantially equal to the axial dimension, parallel to the shaft axis, of each said driving disc; and a plurality of sealing rings of a chemically resistant plastic elastomeric material each pressed into a respective outer ring via an associated axial end face of the respective outer ring such that each sealing ring protrudes for a distance into the respective outer ring via the associated axial end face, with each outer ring which is disposed around a respective driving disc having a respective sealing ring at each axial end face and each outer ring which is disposed around a respective end piece having a respective sealing ring at that axial end face which faces inwardly of the stack, and with said sealing rings being concentric to the axis of said shaft.

2. An assembly as defined in claim 1 wherein each said outer ring is made of polyoxymethylene.

3. An assembly as defined in claim 1 wherein each said end piece comprises an inner disc part and a steel terminating disc having a larger diameter than each said driving disc and said inner disc part and defining an exterior axial surface of said stack, said steel terminating disc being pressed into said outer ring which is disposed around said end piece so as to be flush with the axial end face of that said outer ring which faces outwardly of said stack and said terminating disc lying against said inner disc part.

4. An assembly as defined in claim 1 wherein each said sealing ring and each said outer ring end face into which a respective sealing ring is pressed contacts a respective cutting blade.

* * * * *